United States Patent [19]

Plate

[11] 4,046,065

[45] Sept. 6, 1977

[54] RECTANGULAR AND FLAT BOTTOM BAG AND METHOD OF MANUFACTURE

[76] Inventor: Gary G. Plate, 635 Vickers Court, Burlington, Canada

[21] Appl. No.: 723,699

[22] Filed: Sept. 16, 1976

[30] Foreign Application Priority Data

Aug. 11, 1976 Canada ..... 258890

[51] Int. Cl.[2] ..... B31B 49/04

[52] U.S. Cl. ..... 93/35 SB; 93/DIG. 1

[58] Field of Search ..... 93/14, 18, 35 R, 35 SB, 93/DIG. 1

[56] References Cited

U.S. PATENT DOCUMENTS 3,555,974 1/1971 Davis ..... 93/35 SB

*Primary Examiner*—Gerald A. Dost

*Attorney, Agent, or Firm*—Arne I. Fors

[57] ABSTRACT

A method of manufacturing a novel rectangular, flat-bottomed bag from a sheet of thermoplastic material in which the sheet is folded, a gusset formed at the fold line and a portion of the gusset turned upon an adjacent bag wall to form an outer planar bottom wall and side gusset. The formed sheet is then heat sealed by one or two operations at the planar bottom wall to form an X-weld across the bottom wall, triangular portions of the bottom wall defined by the X-weld severed and removed, and the sheet transversely welded and severed along a line intersecting the center of the X-weld.

4 Claims, 7 Drawing Figures

RECTANGULAR AND FLAT BOTTOM BAG AND METHOD OF MANUFACTURE

BACKGROUND OF THE INVENTION

This invention relates to a method of manufacturing a bag from thermoplastic material and is particularly directed to a method of manufacturing a "square bottom bag," i.e. a rectangular, flat bottom bag from a sheet of heat-sealable plastics material such as polyethylene, polypropylene, and the like.

Carry-out bags commonly used in grocery and supermarket stores conventionally have been manufactured from paper of heavy weight and often of double plie structure to provide adequate strength to the bag and to permit the bag to stand upright. Paper bags, however, suffer from the disadvantage of tearing when improperly loaded, overloaded or wetted by groceries.

Bags formed of plastics film are well known as a substitute for paper bags and are available in a variety of designs. For example, it is well known to provide flat bottoms on bags formed from tubular stock. However, known methods of manufacture normally require a multiplicity of method steps which necessitate complex machinery with attendant high capital and operating costs.

STATEMENT OF INVENTION

It is a principal object of the present invention to provide a simple method of manufacturing a rectangular, flat-bottom bag from flat sheet thermoplastic material which requires a minimum of method steps. The method of the invention generally comprises manufacturing such a rectangular flat-bottom bag from an elongated sheet of heat sealable plastics material by steps including folding said sheet material longitudinally to define a pair of opposed side walls about a fold line, forming a gusset along said fold line having a pair of opposed gusset folds, turning one of said gusset folds upon an adjacent side wall whereby said gusset folds together form an outer planar bottom wall and an inner gusset fold opposed to the adjacent side wall defining an inner fold line, separating the inner gusset fold from the adjacent side wall and transversely heat sealing the sheet material forming the planar bottom wall by an X-weld at an angle of 45° to the inner fold line of the sheet material, whereby the centre of the X-weld intersects the said inner fold line, severing and removing from said sheet material lateral triangular corner portions defined by said X-weld, and transversely welding and severing said stock material along a line intersecting the centre of said X-weld.

It is another important object of the invention to provide an improved rectangular, flat-bottom bag of heat sealable thermoplastic material. The bag of the invention consists of a rectangular flat-bottom bag produced from a sheet of said thermoplastic material comprising a pair of side walls welded together along their longitudinal side edges and joined together by a panel along their bottom edges, one of said side walls having a gusset formed transversely thereof adjacent its bottom edge defining an inner fold line of articulation at about one-half the width of the said bottom panel, said bottom panel having cut-out triangular portions at each corner thereof forming an apex at each end of the bottom panel intersecting the said inner fold line of articulation and a longitudinal side edge whereby said bag will assume a rectangular bottom when in an opened position.

DESCRIPTION OF THE DRAWINGS

These and other objects of the invention and the manner in which they can be attained will become apparent from the following detailed description of the drawing in which.

Like reference characters refer to like parts throughout the description of the drawings.

DESCRIPTION OF THE PREFERRED EMBODIMENT

Figure 1:
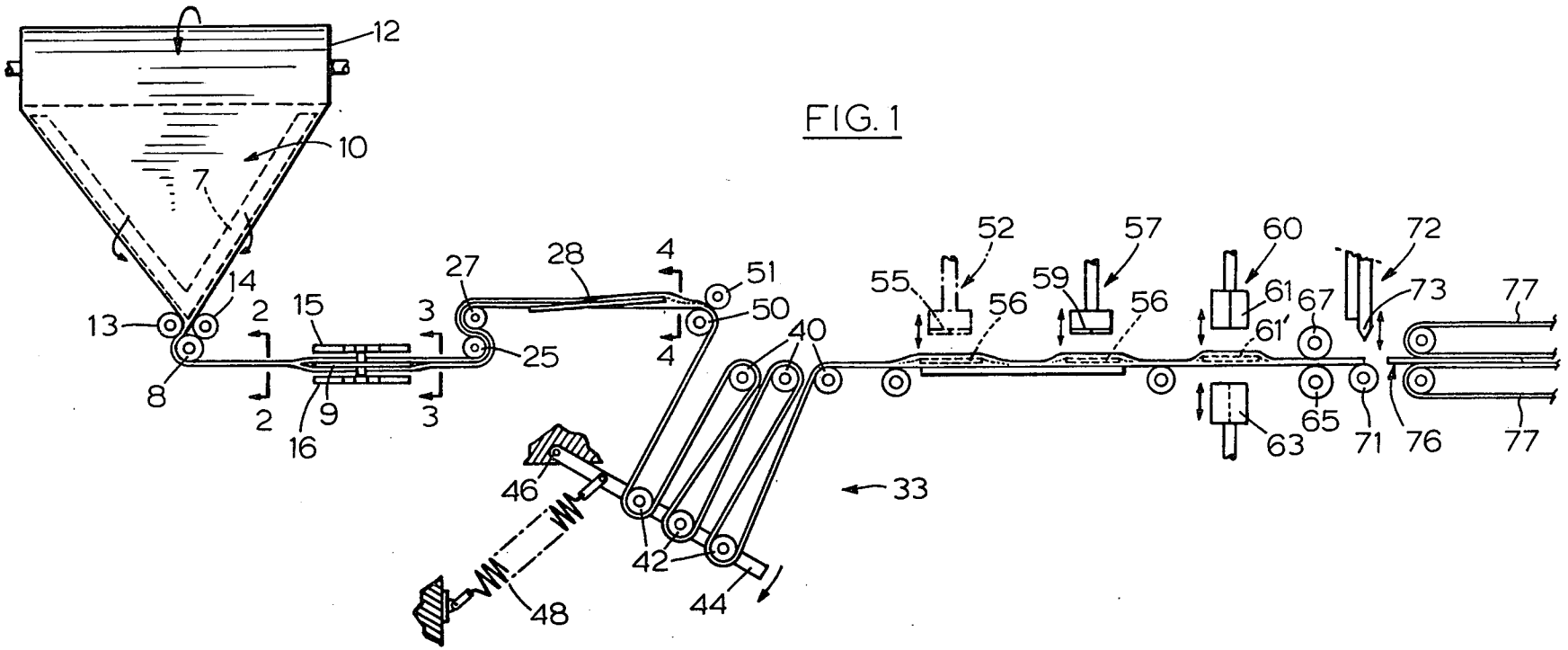
FIG. 1 is a side elevation showing schematically the components of an apparatus for conducting the steps of the method of the present invention.
Figure 2:
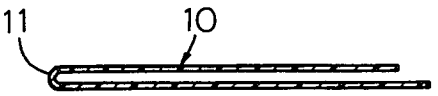
FIG. 2, a transverse section along line 2—2 of FIG. 1, shows sheet stock material having a longitudinal fold line formed medially therein.
Figure 3:
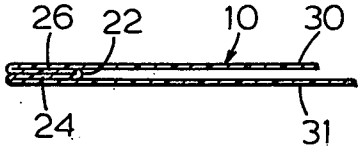
FIG. 3, a transverse section along line 3—3 of FIG. 1, shows the sheet stock material with a gusset formed along the fold line.
Figure 5:
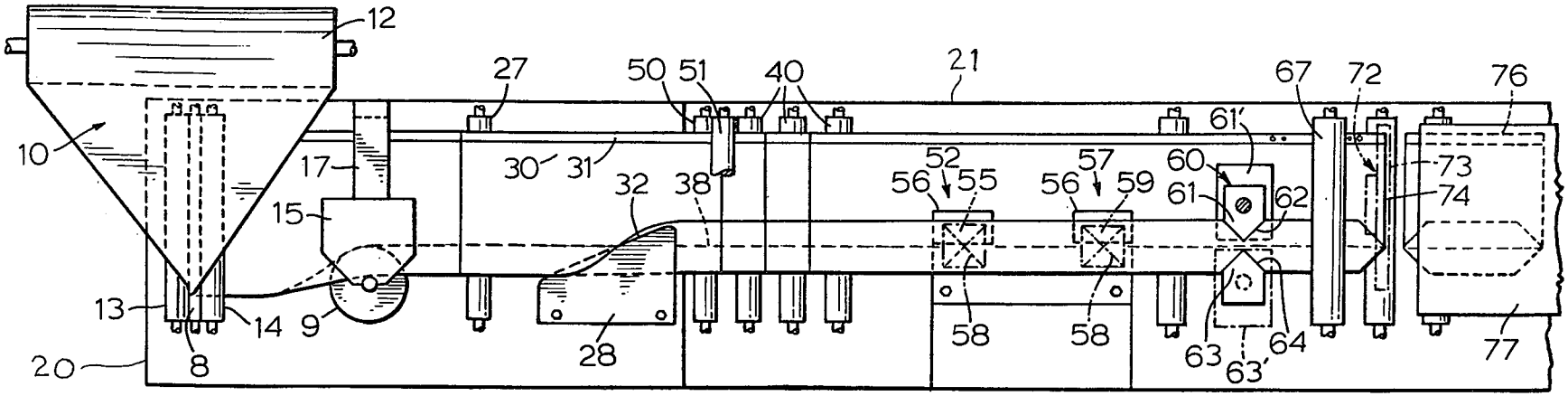
FIG. 5 is a plan view of an apparatus for conducting the method of the present invention.

With specific reference to FIGS. 1 and 5, an elongated sheet of heat sealable plastics material 10, such as thermoplastic film formed of polyethylene, polypropylene or the like, is advanced from a supply roll 12 over V-frame folding board 7 and folded about idler rollers 8, 13 and 14 to form a fold line 11, as indicated in FIG. 2. A gusseting wheel 9 journalled on frame 20 infolds the material along fold line 11 between spaced plates 15, 16 supported by arm 17 to form a gusset 22, shown in FIG. 3, having opposed gusset folds 24, 26 each of which has a depth which corresponds to one-half the width of the bottom panel of the bag to be formed, as will become evident as the description proceeds. The sheet stock material thus prepared comprising a pair of abutting upper and lower side walls 30, 31 joined at one end by gusset 22 and open at the other end, is wrapped about idler rollers 25, 27 to equalize tension on gusset 22 formed on the sheet material 10 from supply roll 12.

The gusseted sheet is then advanced to deflector 28 where upper gusset fold 26 is turned outwardly upon side wall 30 by arcuate deflector edge 32 to form an outer planar bottom wall 34 and an inner gusset fold 36 which defines inner fold line 38 with opposed wall 30.

Sheet material 10 is drawn from supply roll 12 by capstan 50 and pressure roll 51 biased against the said material 10.

The folding, gusseting, turn-over and capstan components of the apparatus preferably are provided on a frame 20 separate from the remainder of the apparatus of the invention, to be described, mounted on frame 21.

Figure 4:
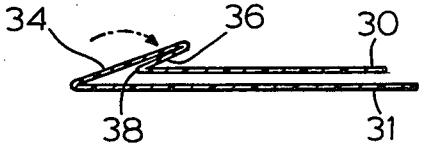
FIG. 4, a transverse section along line 4—4 of FIG. 1, shows the sheet stock material with a gusset fold turned upon an adjacent side wall to form a planar bag bottom.

The sheet stock material is drawn over compensator designated by numeral 33 which comprises a plurality of upper idler rollers 40 journalled for rotation in a fixed position and a plurality of lower idler rollers 42 journalled for rotation on arm 44 which is pivotally mounted by pin 46 at one end thereof. Arm 44 is biased in a clockwise direction, as viewed in FIG. 1, by tension spring 48. Sheet material 10, in the form indicated by FIG. 4, is drawn over capstan 50 and alternately over the plurality of rollers 40, 42 whereby a uniform tension is maintained on sheet material 10 as it is fed intermittently to the final sealing and severing components of the apparatus.

The sheet stock material thus prepared is advanced past an optional presealer 52 wherein inner gusset fold 36 is spaced from adjacent side wall 30 by anvil 56 and the walls of inner gusset fold 36 and side wall 31 abutting bottom panel 34 can be transversely heat and pressure welded to bottom panel 34 by reciprocating sealing bar 55 defining an X-weld 58, shown most clearly in FIG. 5, at an acute angle of about 45° to the longitudinal inner fold line 38. The intersection of the arms of the X-weld 58 are centered across bottom panel 34 such that the said intersection coincides with inner fold line 38.

The presealed sheet material is advanced to a final sealer 57 wherein a second reciprocating sealing bar 59 and anvil 56 completes the X-weld 58. The use of two-stage heat sealing is required only for heavy gauge thermoplastic materials and the first stage heat sealing normally would not be required for thin materials such as 2 mil. polyethylene or polypropylene.

The heat and pressure welded stock material having X-weld 58 is next advanced to trimmer 60 where reciprocating cutters 61, 63 acting on anvils 61', 63', respectively, sever triangular portions 62, 64 from bottom panel 34, said portions being removed by a vacuum device, not shown. Two sets of perforations 66, 68 are concurrently formed in the overlap 69 of wall 31, perforations 66 each having a slit 70 adjacent thereto.

The stock material having the cut-outs removed is then advanced to sealer-cutter 72 by draw rollers 65, 67 where the stock material is laterally side welded and severed against roll 71 by side-weld bar 73, as indicated by transverse line 74, which intersects the juncture of the lines of X-weld 58. The severed and completed bag 76 is removed and stacked by opposed conveyor belts 77.

Figure 6:
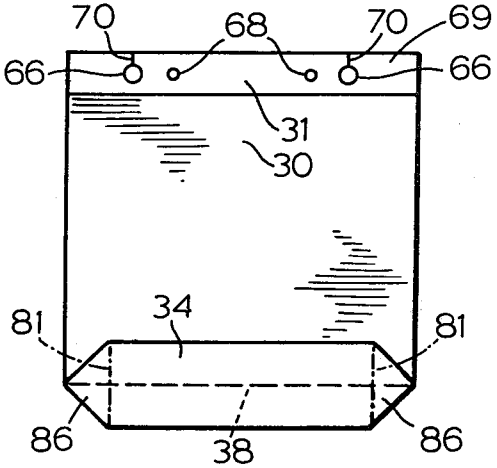
FIG. 6 is a plan view of a bag produced by the method of the invention, before opening.
Figure 7:
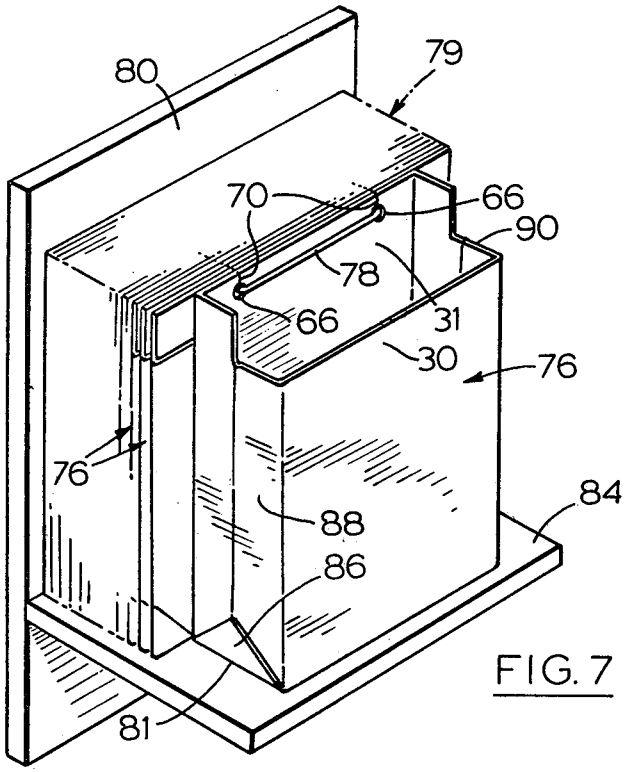
FIG. 7 is a perspective view of a plurality of the said bags, one of which is in its opened position, suspended vertically.

The formed bag 76 is shown in FIG. 6 in a flattened position in which it is stacked for bundling. FIG. 7 illustrates the bag in its open position at, for example, a counter where a bundle 79 of bags 76 is supported by horizontal wire 78 extending from support wall 80 through perforations 66. The outermost bag 76 can be opened and, as contents are placed in the bag, the bag bottom assumes a flattened rectangular configuration seated on the counter 84 as the bottom panel 34 folds along lines designated 81, FIG. 6, and triangular panel portions 86 form part of end walls 88, 90.

When the bag is filled, it is torn from support wire 78, slits 70 facilitating tearing of the plastics material, exposing the next bag which can be opened for filling. Perforations 68 can be used by the customer for supporting each bag for storage and for support of contents.

It will be undersgood, of course, that modifications can be made in the embodiment of the invention illustrated and described herein without departing from the scope and purview of the invention as defined by the appended claims.

What I claim as new and desire to protect by Letters Patent of the United States is:

1. A method of manufacturing a rectangular, flat bottom bag from heat sealable plastics sheet material which comprises: folding said sheet material longitudinally to define a pair of opposed side walls about a fold line, forming a gusset along said fold line having a pair of opposed gusset folds, turning one of said gusset folds upon an adjacent side wall whereby said gusset folds together form an outer planar bottom panel and an inner gusset fold opposed to the adjacent side wall defining an inner fold line, separating the inner gusset fold from the adjacent side wall and transversely heat sealing the sheet material forming the planar bottom panel by an X-weld at an acute angle to the inner fold line of the sheet material, whereby the centre of the X-weld intersects the said inner fold line, severing and removing from said sheet material lateral triangular corner portions defined by said X-weld, and transversely welding and severing said stock material along a line intersecting the centre of said X-weld.

2. A method as claimed in claim 1, separating the inner gusset fold from the adjacent side wall by interposing an anvil therebetween.

3. A method as claimed in claim 2 in which said acute angle is about 45°.

4. A method as claimed in claim 3, transversely heat sealing the sheet material forming the planar bottom panel in two stages by a preseal and a final seal co-incident with the preseal.

* * * * *